US010441049B2

(12) United States Patent
Douglas et al.

(10) Patent No.: US 10,441,049 B2
(45) Date of Patent: Oct. 15, 2019

(54) HAND HELD APPLIANCE

(71) Applicant: Dyson Technology Limited, Wiltshire (GB)

(72) Inventors: Craig Douglas, Swindon (GB); Christopher William Hedges, Guildford (GB); Antoine Francois Atkinson, Swindon (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 234 days.

(21) Appl. No.: 14/971,916

(22) Filed: Dec. 16, 2015

(65) Prior Publication Data

US 2016/0166035 A1 Jun. 16, 2016

(30) Foreign Application Priority Data

Dec. 16, 2014 (GB) ..... 1422356.4

(51) Int. Cl.
*A45D 20/10* (2006.01)
*A45D 20/12* (2006.01)

(52) U.S. Cl.
CPC ..... *A45D 20/10* (2013.01); *A45D 20/12* (2013.01)

(58) Field of Classification Search
CPC ..... A45D 20/10; A45D 20/12
See application file for complete search history.

(56) References Cited

U.S. PATENT DOCUMENTS

| | | | |
|---|---|---|---|
| 3,721,250 | A | 3/1973 | Walter et al. |
| 4,596,921 | A | 6/1986 | Hersh et al. |
| 5,875,562 | A | 3/1999 | Fogarty |
| 2011/0079239 | A1 | 4/2011 | Hall |
| 2011/0203128 | A1 | 8/2011 | Rodrigues |
| 2013/0045084 | A1 | 2/2013 | Tu et al. |

FOREIGN PATENT DOCUMENTS

| | | |
|---|---|---|
| CN | 102058228 | 5/2011 |
| CN | 102309121 | 1/2012 |
| CN | 202146022 | 2/2012 |
| CN | 202407590 | 9/2012 |
| EP | 0300281 | 1/1989 |
| GB | 1446385 | 8/1976 |

(Continued)

OTHER PUBLICATIONS

International Search Report and Written Opinion dated Feb. 5, 2016, directed to International Application No. PCT/GB2015/053576; 16 pages.

(Continued)

*Primary Examiner* — Jessica Yuen

(74) *Attorney, Agent, or Firm* — Morrison & Foerster LLP

(57) ABSTRACT

A hand held appliance including a wall, a fluid flow path extending within the wall from a fluid inlet into the appliance to a fluid outlet from the appliance, a fan unit extending longitudinally within the wall for drawing fluid into the fluid inlet wherein the fan unit is non-concentric with respect to the wall. The fan unit may be positioned coaxially within the fluid flow path. The wall has a thickness and the thickness of the wall may varies. The wall may be generally tubular and the thickness of the wall varies around a circumference of the wall. The wall may be generally tubular and has an inner surface and an outer surface. A central axis of the inner surface may be different to a central axis of the outer surface.

22 Claims, 5 Drawing Sheets

(56) References Cited

FOREIGN PATENT DOCUMENTS

| | | |
|---|---|---|
| GB | 2482548 | 2/2012 |
| GB | 2500802 | 10/2013 |
| GB | 2500798 | 5/2014 |
| JP | 52-29579 | 3/1977 |
| JP | 58-32706 | 3/1983 |
| JP | 60-135700 | 7/1985 |
| JP | 60-249907 | 12/1985 |
| JP | 63-238807 | 10/1988 |
| JP | 64-27506 | 1/1989 |
| JP | 64-29208 | 1/1989 |
| JP | 2-15005 | 1/1990 |
| JP | 7-155219 | 6/1995 |
| JP | 8-343 | 1/1996 |
| JP | 2002-238649 | 8/2002 |
| JP | 2006-181297 | 7/2006 |
| JP | 2007-136121 | 6/2007 |
| JP | 2010-22561 | 2/2010 |
| JP | 2014-217770 | 11/2014 |
| WO | WO-2012/069983 | 5/2012 |

OTHER PUBLICATIONS

Search Report dated May 26, 2015, directed to GB Application No. 1422356.4; 3 pages.

HAND HELD APPLIANCE

REFERENCE TO RELATED APPLICATIONS

This application claims the priority of United Kingdom Application No. 1422356.4, filed Dec. 16, 2014, the entire contents of which are incorporated herein by reference.

FIELD OF THE INVENTION

This invention relates to a hand held appliance and in particular a hair care appliance such as a hairdryer.

BACKGROUND OF THE INVENTION

Generally, a motor and fan are provided which draw fluid into a body; the fluid may be heated prior to exiting the body. The motor is susceptible to damage from foreign objects such as dirt or hair so conventionally a filter is provided at the fluid inlet. The fan and heater require power in order to function and this is provided via internal wiring from either a mains power cable or batteries attached to the appliance.

SUMMARY OF THE INVENTION

According to a first aspect, the invention provides a hand held appliance comprising a wall, a fluid flow path extending within the wall from a fluid inlet into the appliance to a fluid outlet from the appliance, a fan unit extending longitudinally within the wall for drawing fluid into the fluid inlet wherein the fan unit is non-concentric with respect to the wall.

According to an aspect, the invention provides a hand held appliance comprising a wall, a fluid flow path extending within the wall from a fluid inlet into the appliance to a fluid outlet from the appliance, a fan unit for drawing fluid into the fluid inlet wherein the fan unit is positioned asymmetrically within the wall.

According to another aspect, the invention provides a hand held appliance comprising a wall, a fluid flow path extending within the wall from a fluid inlet into the appliance to a fluid outlet from the appliance, a fan unit for drawing fluid into the fluid inlet wherein the fan unit is eccentric with respect to the wall.

The fan unit comprises an impeller and a motor for driving the impeller. Preferably, the impeller is axially aligned within the wall.

Preferably, the fan unit is positioned coaxially within the fluid flow path. Thus, the fluid flow path is non-concentric, asymmetrical or eccentric within the wall.

The fan unit is located within the fluid flow path between the fluid inlet and the fluid outlet. Thus, the impeller and the motor for driving the impeller are located within the fluid flow path between the fluid inlet and the fluid outlet. Fluid that enters the fluid inlet flows passed the impeller and the motor for driving the impeller.

Having the fan unit and fluid flow path positioned off centre within the wall has a number of advantages; it provides a space within the wall for housing components, for example the wires; this space is provided with a smaller increase in diameter than if all the components were axially aligned.

Preferably, the wall has a thickness and the thickness of the wall varies. It is preferred that the wall is generally tubular and the thickness of the wall varies around a circumference of the wall. Preferably, the wall is generally tubular and has an inner surface and an outer surface. It is preferred that a central axis of the inner surface is different to a central axis of the outer surface.

It is preferred that the wall is formed from two parts. Preferably one of the wall parts is thicker than the other one of the wall parts.

Preferably, power is supplied to the fan unit by wires extending from a power source and wherein the wires extending from the power source are housed in the wall. It is preferred that the wall is locally thicker in the vicinity of the wires.

Preferably, wherein the wall comprises channels extending along the wall for housing the wires. It is preferred that the channels extend along the wall at least passed the fan unit.

Preferably, the appliance comprises a control switch, wherein the control switch is aligned with the wires.

Preferably, the appliance comprises a control switch wherein the control switch is aligned with the channels.

In a preferred embodiment, the appliance has a body comprising a first end and a second end and a handle extending from the body wherein the wires extend along the handle in the wall and the wires are radially located within the handle proximate the first end of the body.

Preferably, the appliance comprises a control switch, wherein the control switch is proximate the first end of the body.

Preferably, the second end of the body comprises the fluid outlet from the appliance.

It is preferred that the handle comprises the fluid inlet into the appliance.

Preferably, the body comprises a further fluid inlet into the appliance.

Preferably, a further fluid flow path extends axially through the appliance from the further fluid inlet to the second end of the body.

It is preferred that the handle is orthogonal to the body and the fluid inlet is disposed at the distal end of the handle from the body.

Preferably, the fan unit comprises an impeller and a motor for driving the impeller.

It is preferred that the impeller is aligned axially within the wall.

Preferably, the appliance is a hair care appliance.

Preferably, the hair care appliance is a hairdryer.

BRIEF DESCRIPTION OF THE DRAWINGS

The invention will now be described, by way of example only, with reference to the accompanying drawings, in which.

DETAILED DESCRIPTION OF THE INVENTION

Figure 1:
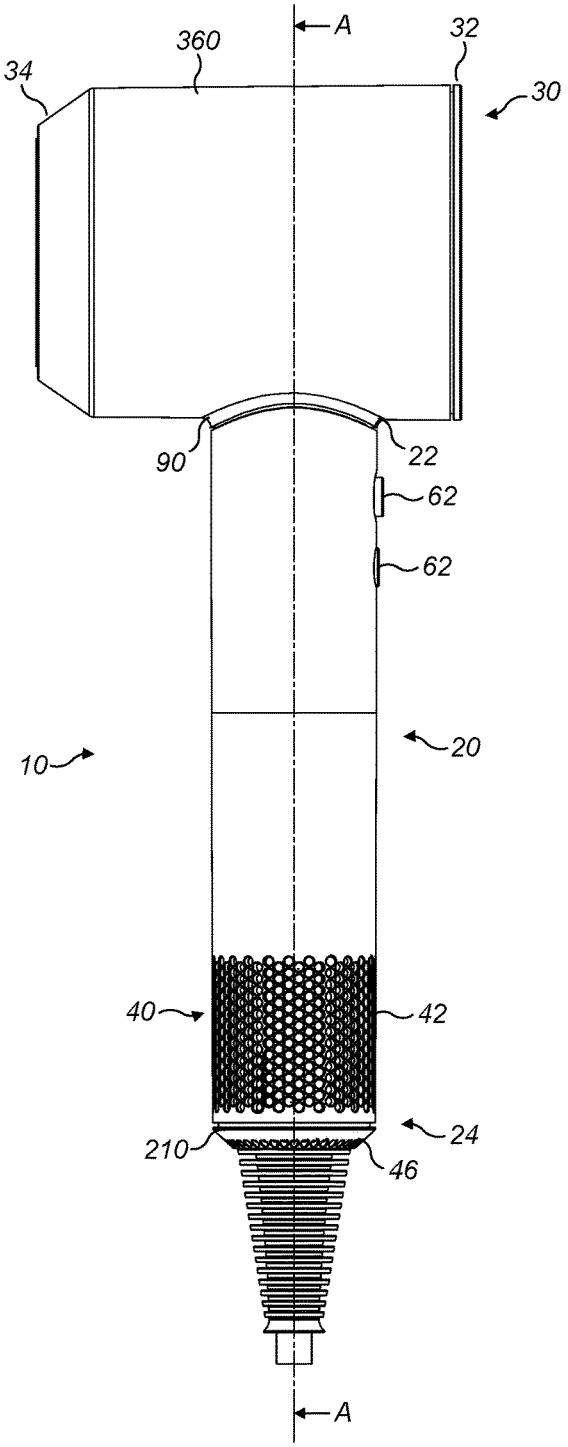
FIG. 1 shows a hairdryer according to the invention.

FIGS. 1, 2, 3*a* and 3*b* show a hairdryer 10 with a handle 20 and a body 30. The handle has a first end 22 which is connected to the body 30 and a second end 24 distal from the body 30 and which includes a primary inlet 40. Power is supplied to the hairdryer 10 via a cable 50.

Figure 2:
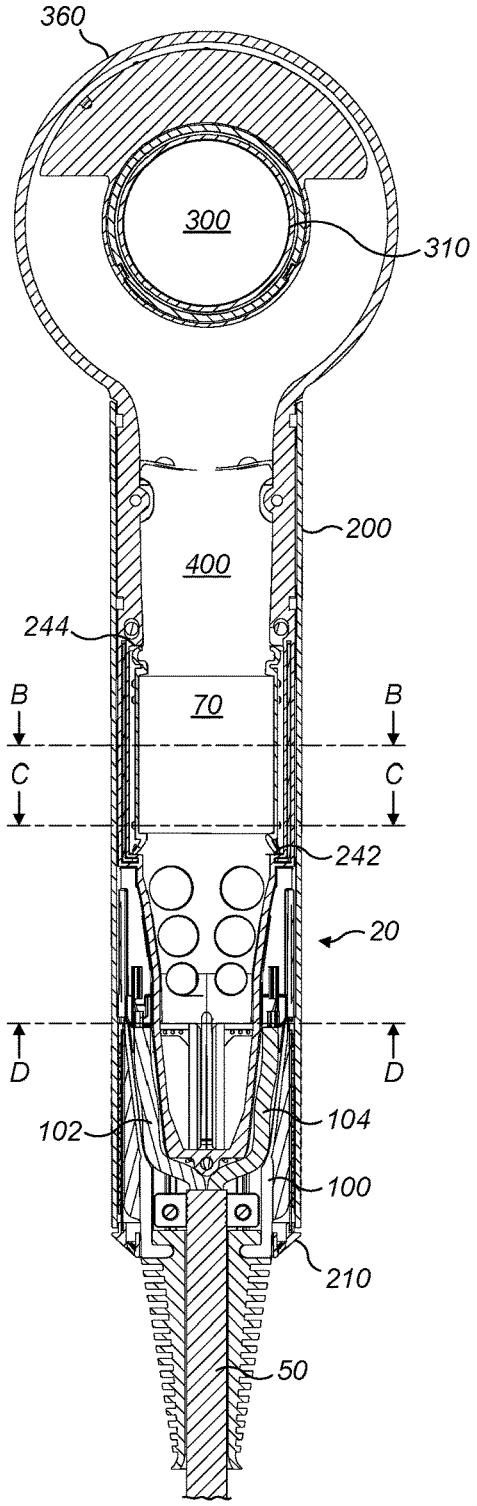
FIG. 2 shows a cross-section through line A-A of the hairdryer shown in FIG. 1.
Figure 3A:
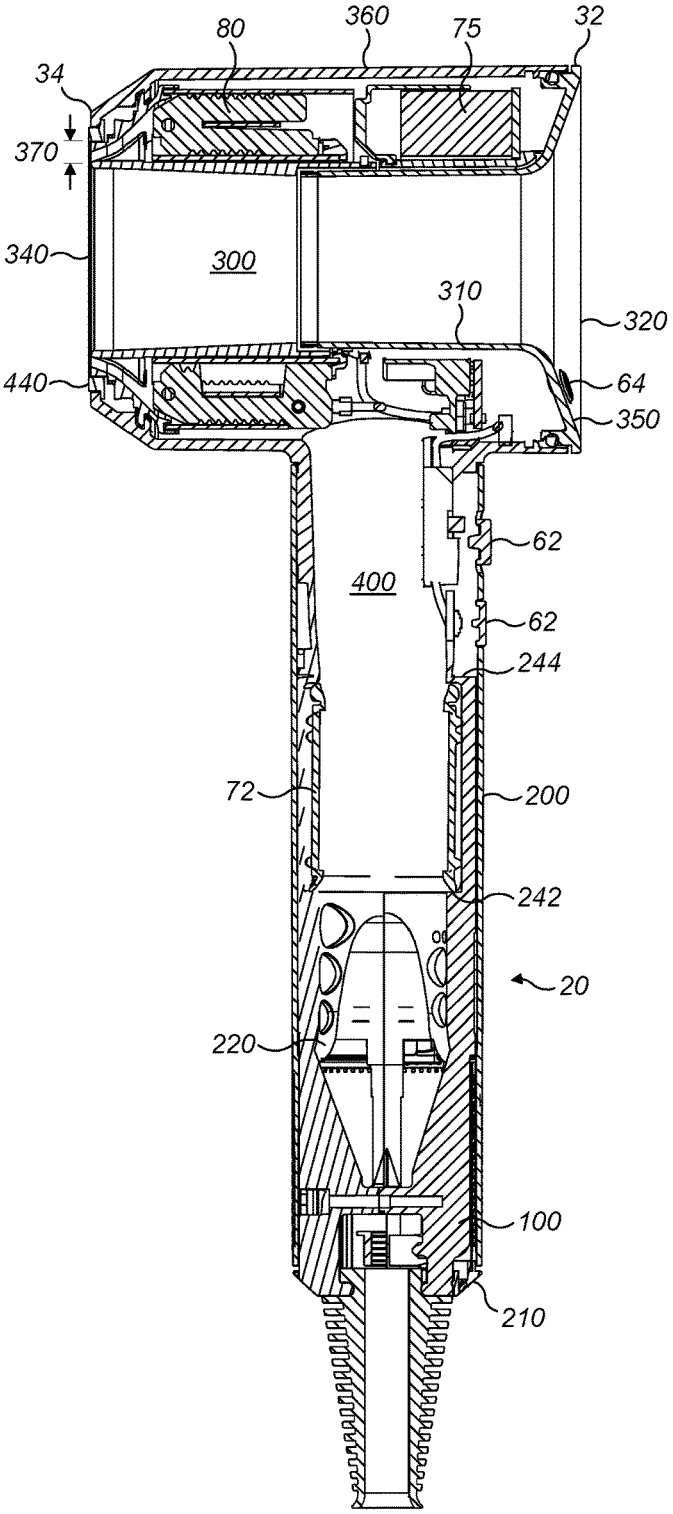
FIG. 3*a* shows a further cross-section though the hairdryer shown in FIG. 1.

Referring now to FIGS. 2 and 3*a* in particular which show a simplified version of the internal components of the hairdryer, the handle 20 has an outer wall 200 which extends from the body 30 to a distal end 24 of the handle. At the distal end 24 of the handle an end wall 210 extends across the outer wall 200. The cable 50 enters the hairdryer through this end wall 210. The primary inlet 40 in the handle 20 includes first apertures that extend around and along 42 the outer wall 200 of the handle and second apertures that extend across 46 and through the end wall 210 of the handle 20. The cable 50 is located approximately in the middle of the end wall 210 so extends from the centre of the handle 20.

It is preferred that the cable 50 extends centrally from the handle 20 as this means the hairdryer is balanced regardless of the orientation of the handle 20 in a users' hand. Also, if the user moves the position of their hand on the handle 20 there will be no tugging from the cable 50 as it does not change position with respect to the hand when the hand is moved. If the cable were offset and nearer one side of the handle then the weight distribution of the hairdryer would change with orientation which is distracting for the user.

Upstream of the primary inlet 40, a fan unit 70 is provided. The fan unit 70 includes a fan and a motor. The fan unit 70 draws fluid through the primary inlet 40 towards the body 30 through a fluid flow path 400 that extends from the primary inlet 40 and into the body 30 where the handle 20 and the body 30 are joined 90. The fluid flow path 400 continues through the body 30, around a heater 80 and to a primary fluid outlet 440 where fluid that is drawn in by the fan unit exits the primary fluid flow path 400. The primary fluid flow path 400 is non linear and flows through the handle 20 in a first direction and through the body 30 in a second direction which is orthogonal to the first direction.

The body 30 has a first end 32 and a second end 34 and includes an outer wall 360 and an inner duct 310. The primary fluid flow path 400 extends along the body from the junction 90 of the handle 20 and the body 30 between the outer wall 360 and the inner duct 310 towards the primary fluid outlet 440 at the second end of the body 30.

Another fluid flow path is provided within the body; this flow is not directly processed by the fan unit or the heater but is drawn into the hairdryer by the action of the fan unit producing the primary flow through the hairdryer. This fluid flow is entrained into the hairdryer by the fluid flowing through the primary fluid flow path 400.

The first end 32 of the body includes a fluid inlet 320 and the second end 34 of the body includes a fluid outlet 340. Both the fluid inlet 320 and the fluid outlet 340 are at least partially defined by the inner duct 310 which is an inner wall of the body 30 and extends within and along the body. A fluid flow path 300 extends within the inner duct from the fluid inlet 320 to the fluid outlet 340. At the first end 32 of the body 30, a side wall 350 extends between the outer wall 360 and the inner duct 310. This side wall 350 at least partially defines the fluid inlet 320. At the second end 34 of the body a gap 370 is provided between the outer wall 360 and the inner duct 310, this gap 370 defines the primary fluid outlet 440. The primary fluid outlet 440 is annular and surrounds the fluid flow path. The primary fluid outlet 440 may be internal so the primary fluid flow path 400 merges with the fluid flow path 300 within the body 30. Alternatively, the primary fluid outlet 440 is external and exits from the body 30 separately to the fluid from the fluid flow path 300 at the fluid outlet 340.

A printed circuit board (PCB) 75 including the control electronics for the hairdryer is located in the body 30 near the side wall 350 and fluid inlet 320. The PCB 75 is ring shaped and extends round the inner duct 310 between the inner duct 310 and the outer wall 360. The PCB 75 is in fluid communication with the primary fluid flow path 400. The PCB 75 extends about the fluid flow path 300 and is isolated from the fluid flow path 300 by the inner duct 310.

The PCB 75 controls such parameters as the temperature of the heater 80 and the speed of rotation of the fan unit 70. Internal wiring (not shown) electrically connects the PCB 75 to the heater 80 and the fan unit 70 and the cable 50. Control buttons 62, 64 are provided and connected to the PCB 75 to enable a user to select from a range of temperature settings and flow rates for example.

In use, fluid is drawn into the primary fluid flow path 400 by the action of the fan unit 70, is optionally heated by the heater 80 and exits from the primary fluid outlet 440. This processed flow causes fluid to be entrained into the fluid flow path 300 at the fluid inlet 320. The fluid combines with the processed flow at the second end 34 of the body. In the example shown in FIG. 2, the processed flow exits the primary fluid outlet 440 and the hairdryer as an annular flow which surrounds the entrained flow that exits from the hairdryer via the fluid outlet 340. Thus fluid that is processed by the fan unit and heater is augmented by the entrained flow.

Figure 3B:
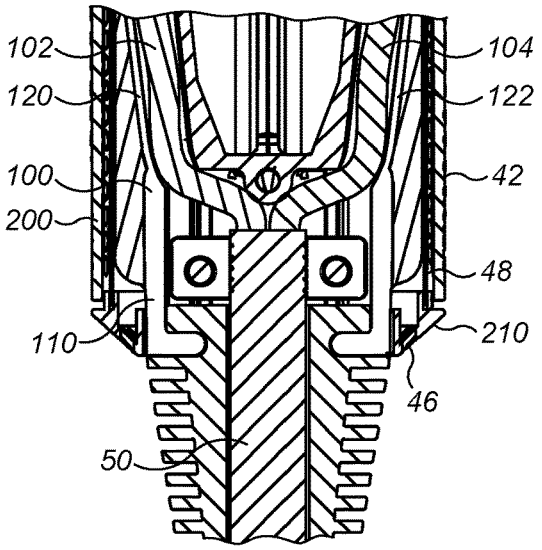
FIG. 3*b* shows an enlarged view of the inlet area of the hairdryer shown in FIG. 3*a;*
Figure 4:
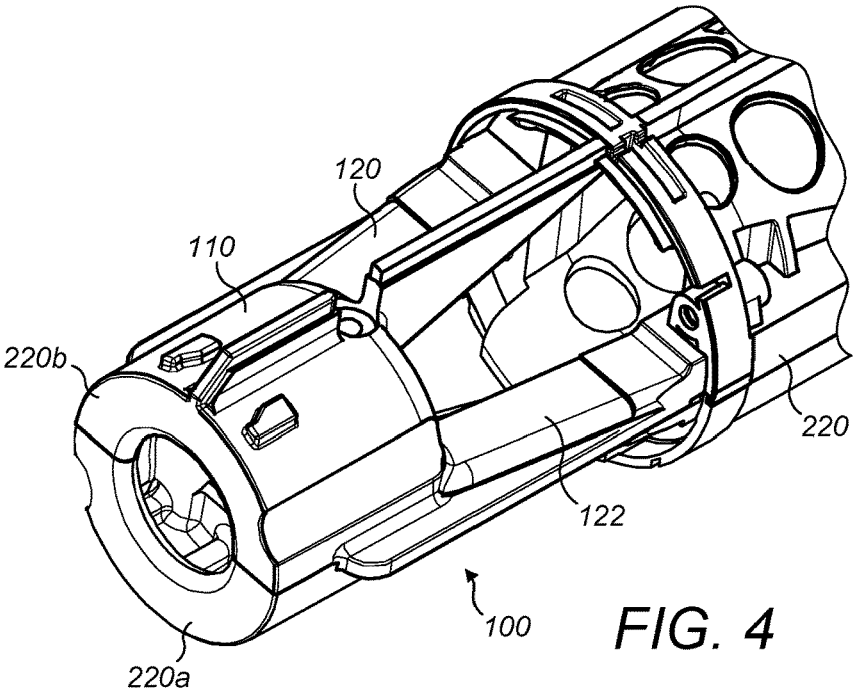
FIG. 4 shows a an isometric view of the inner structure of the handle of the hairdryer of FIG. 1.

Referring now to FIGS. 3*a*, 3*b* and 4 which shows the primary inlet area in more detail, a device 100 for distributing wires 102, 104 has a central hub 110 which houses the cable 50 and a pair of arms 120, 122 which house the wires 102, 104 as they are routed from the central hub 110 towards an inner wall 220 of the handle 20 of hairdryer 10.

The inner wall 220 has a greater diameter than the central hub 110 so the wires 102, 104 with the arms 120, 122 extend from the central hub 110 radially outwards towards the inner wall 220 forming a generally "Y" shaped device 100.

Referring to FIG. 4 in particular, the inner wall 220 is formed from two parts 220*a*, 220*b*; this simplifies assembly of the parts that are housed within the inner wall 220. For example parts such as the fan unit 70 and wires 102, 104 may be placed within one of the two parts of the inner wall 220 then when all the parts are aligned correctly, the two parts of the inner wall 200 may be joined together to form an inner handle of the hairdryer 10.

The wires 102, 104 are housed within the arms 120, 122 which can be hollow shells but are alternatively solid with recesses adapted to accommodate a wire passing through the arm.

Figure 5:
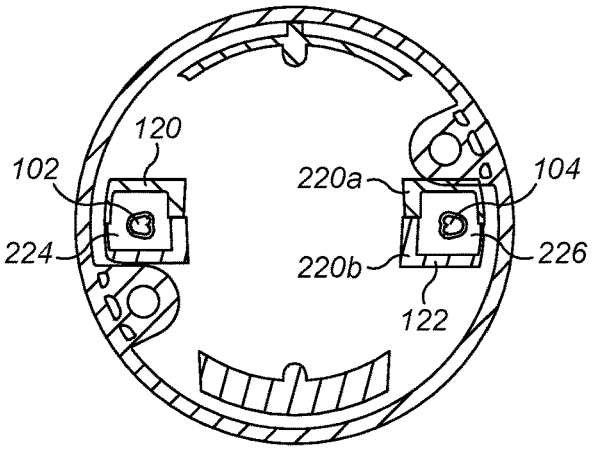
FIG. 5 shows a cross section through the hairdryer of FIG. 1 at line B-B.
Figure 6:
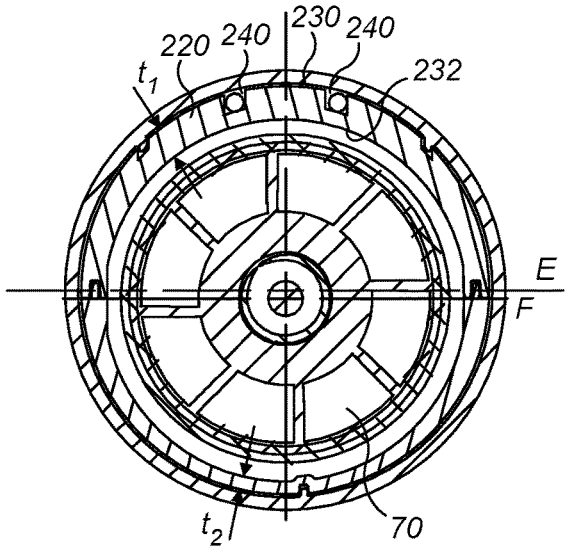
FIG. 6 shows a cross section through the hairdryer of FIG. 1 at line C-C.
Figure 7:
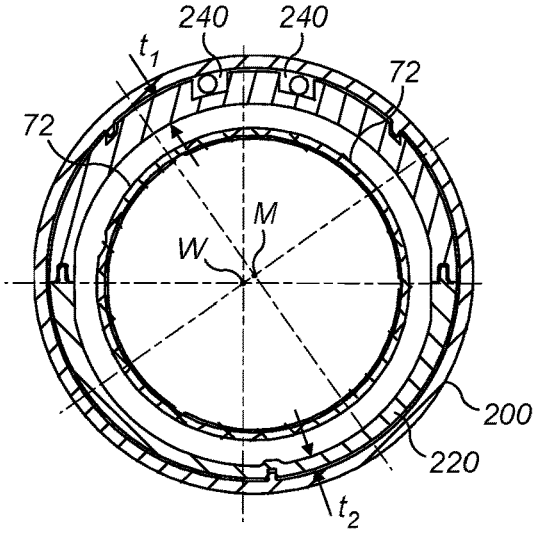
FIG. 7 shows a cross section through the hairdryer of FIG. 1 at line D-D.

Referring to FIG. 5 in particular, the inner wall 220 includes a pair of recesses 224, 226 which in this example are partly formed in each of the two parts of the inner wall 220*a*, 220*b* and when the two parts of the inner wall 220*a*, 220*b* are assembled the pair of recesses 224, 226 are created to house the wires 102, 104. Thus, the wires 102, 104 are protected from being snagged or caught and are safely out of the fluid flow path 400 where they would cause some disruption to the flow of fluid.

The cable 50 includes a live wire 104 and a neutral wire 102. The neutral wire 102 passes from the device for distributing wires 100 and into one of the recesses 226 and live wire 104 also passes from the device for distributing wires 100 and into a second recess 224.

Referring to FIGS. 2, 3*a* and 5 to 7 in particular, the fan unit 70 is supported within the inner wall 220 by two annular seats which retain the motor longitudinally within the inner wall 220 and thus the handle 20. The recesses 224, 226 could continue passed the fan unit 70, however in this embodiment, the recesses 224, 226 are discontinued where they meet the first annular seat 242. Both the neutral wire 102 and the live wire 104 are routed from their respective recesses 224, 226 radially around the inner wall 220*a* and then longitudinally along a pair of channels 240 formed within the inner wall 220*a*. The pair of channels 240 is designed to receive the live wire 104 and the neutral wire 102 and hold those wires in place around the fan unit 70.

In order to fit the wires 102, 104 within the inner wall 220, the inner wall 220 is has a greater thickness t1 in the vicinity of the wires 102,104 compared to the thickness t2 of the inner wall 220 diametrically opposite the wires 102, 104. The thickness of the inner wall 220 may also vary along the length of the fan unit 70.

The inner wall 220 has an outer surface 230 having a central axis E and an inner surface 232 having a central axis F. Axes E and F are different thus the fluid flow path 400 does not flow centrally through the inner wall 220 or the handle 20 of the hairdryer. The fan unit 70 is disposed approximately centrally of the inner surface 242 of the inner wall 220 within motor mount 72. The central axis M of the fan unit 70 is substantially the same as the central axis F of the inner surface 232 of the inner wall 200. The central axis M of the fan unit is offset with respect to the central axis F of the outer surface 230 of the inner wall 200 and the central axis W of the outer wall 200.

Having a variable thickness in the inner wall 220 along with a fan unit 70 and fluid flow path 400 which are off-centre within the outer wall 200 of the handle 20 means that the diameter of the outer wall 200 of the handle 20 can be reduced compared to the diameter that would be required if all those components were axially aligned, for example by having a constant thickness around the circumference of the inner wall 220.

Upstream of the fan unit 70 is a control switch 62. In order to simplify the wiring within the hairdryer, the control switch 64 is approximately radially disposed in line with the pair of channels 240.

The invention has been described in detail with respect to a hairdryer however, it is applicable to any appliance that draws in a fluid and directs the outflow of that fluid from the appliance.

The appliance can be used with or without a heater; the action of the outflow of fluid at high velocity has a drying effect.

The fluid that flows through the appliance is generally air, but may be a different combination of gases or gas and can include additives to improve performance of the appliance or the impact the appliance has on an object the output is directed at for example, hair and the styling of that hair.

The invention is not limited to the detailed description given above. Variations will be apparent to the person skilled in the art.

The invention claimed is:

1. A hand held appliance comprising a wall having a cylindrical outer surface and an inner surface, the cylindrical outer surface having a central longitudinal axis, a fluid flow path extending within the wall from a fluid inlet into the appliance to a fluid outlet from the appliance, a fan extending longitudinally within the wall for drawing fluid into the fluid inlet, wherein the fan has a rotation axis that is the same as a central longitudinal axis of the inner surface of the wall and different than the central longitudinal axis of the cylindrical outer surface of the wall.

2. The appliance of claim 1, wherein the fan is positioned coaxially within the fluid flow path.

3. The appliance of claim 1, wherein the wall is generally tubular and the thickness of the wall varies around a circumference of the wall.

4. The appliance of claim 1, wherein the wall is generally tubular and has an inner surface and an outer surface.

5. The appliance of claim 4, wherein a central axis of the inner surface is different to a central axis of the outer surface.

6. The appliance of claim 1, wherein power is supplied to a fan unit comprising the fan by wires extending from a power source and wherein the wires extending from the power source are housed in the wall.

7. The appliance of claim 6, wherein the wall is locally thicker in the vicinity of the wires.

8. The appliance of claim 6, wherein the wall comprises channels extending along the wall for housing the wires.

9. The appliance of claim 8, wherein the channels extend along the wall at least past the fan unit.

10. The appliance of claim 8, comprising a control switch wherein the control switch is aligned with the channels.

11. The appliance of claim 6, comprising a control switch, wherein the control switch is aligned with the wires.

12. The appliance of claim 6, wherein the appliance has a body comprising a first end and a second end and a handle extending from the body wherein the wires extend along the handle in the wall and the wires are radially located within the handle proximate the first end of the body.

13. The appliance of claim 12, comprising a control switch, wherein the control switch is proximate the first end of the body.

14. The appliance of claim 12, wherein the second end of the body comprises the fluid outlet from the appliance.

15. The appliance of claim 12, wherein the handle comprises the fluid inlet into the appliance.

16. The appliance of claim 12, wherein the body comprises a further fluid inlet into the appliance.

17. The appliance of claim 16, wherein a further fluid flow path extends axially through the appliance from the further fluid inlet to the second end of the body.

18. The appliance of claim 12, wherein the handle is orthogonal to the body and the fluid inlet is disposed at the distal end of the handle from the body.

19. The appliance of claim 1, comprising a motor for driving the fan.

20. The appliance of claim 19, wherein the fan is aligned axially within the wall.

21. The appliance of claim 1, wherein the appliance is a hair care appliance.

22. The appliance of claim 21, wherein the hair care appliance is a hairdryer.

* * * * *